United States Patent [19]

Schwab

[11] 4,124,162

[45] Nov. 7, 1978

[54] SHROUD FOR A SUBMERGED JET CUTTING NOZZLE

[76] Inventor: Thomas L. Schwab, 1369 Windsor Way, Livermore, Calif. 94550

[21] Appl. No.: 750,678

[22] Filed: Dec. 15, 1976

[51] Int. Cl.[2] ..... E21B 7/18

[52] U.S. Cl. ..... 239/288.5; 175/67; 175/393; 299/17

[58] Field of Search ..... 239/288.5, 499; 175/67, 175/340, 393, 422; 166/222, 223, 298; 299/17; 37/62, 63, 78

[56] References Cited

U.S. PATENT DOCUMENTS

| | | | |
|---|---|---|---|
| 1,852,903 | 4/1932 | Salmon | 175/422 X |
| 2,587,243 | 2/1952 | Sweetman | 102/24 |
| 2,678,203 | 5/1954 | Huff | 175/422 X |
| 3,055,442 | 9/1962 | Prince | 175/422 X |
| 3,140,713 | 7/1964 | Ismach | 128/173 |
| 3,524,367 | 8/1970 | Franz | 83/53 |
| 3,672,380 | 6/1972 | Schuster | 134/172 |
| 3,891,157 | 6/1975 | Justus | 242/56.2 |
| 3,938,600 | 2/1976 | Essmeier | 175/67 X |
| 3,963,180 | 6/1976 | Wagner | 239/288.5 |

*Primary Examiner*—Robert W. Saifer
*Attorney, Agent, or Firm*—C. Michael Zimmerman

[57] ABSTRACT

A shroud for a submerged jet cutting nozzle is described which separates the jet from surrounding fluid environment and enhances the cutting effect.

3 Claims, 4 Drawing Figures

SHROUD FOR A SUBMERGED JET CUTTING NOZZLE

BACKGROUND OF THE INVENTION

High speed fluid jets are widely used for special cutting and drilling applications. Studies have shown that the jet cutting effect is greatest when a fluid jet of relatively high density, such as water, is exhausted into a low density medium, such as air. Studies on the cutting effect of liquid jets in air have shown that the cutting effect is maximized at particular standoff distances between the nozzle exit and the workpiece. With conventional arrangements, one such distance is between 200–300 times the nozzle orifice diameter (the so-called "far zone"); another enhancement of cutting effect is observed at 10–20 nozzle orifice diameters (the so-called "near zone"). (See N. C. Franz, "The Influence of Standoff Distance on Cutting with High Velocity Fluid Jets," Paper B-3, Second International Symposium on Jet Cutting Technology, Apr. 2–4, 1974, St. John's College, Cambridge, England.)

It has been observed that when the jet/medium density ratio is small, such as a ratio of 1:1 for a water jet exhausted into a water medium, the cutting effect decreases rapidly with distance from the jet nozzle exit. This inherent limitation on the cutting effect of submerged fluid jets has hindered their use in certain important applications, such as in petroleum drilling, where the jet would be submerged in a high-density medium, such as drilling mud.

SUMMARY OF THE INVENTION

The present invention provides a shroud for a fluid jet cutting nozzle which enhances the cutting effect of the jet. In its basic aspects, the shroud of the invention comprises an open-ended, elongated tube having a liquid entrance end adapted to be secured generally hermetically to the nozzle circumscribing the fluid discharge orifice thereof, and a fluid discharge end opposite the entrance end so that a jet of cutting fluid emanating from the nozzle will flow through such tube. The cross-sectional area and shape of the interior of the tube is selected to be spaced for substantially its full length from the fluid jet emanating from the orifice. The result is that the fluid jet reduces the pressure in the tube, and its flow therethrough can be characterized as flow through an intermediate, sudden expansion chamber prior to its impingement on the work to be cut. When the jet cutting fluid is a liquid and air is in the tube, a two phase (gas-liquid) flow is induced by the presence of the shroud.

It has been found that with the invention the fluid pressure thresholds resulting in cutting at the previously mentioned far zone are significantly reduced. In other words, the distance to the far cutting zone is shortened significantly. For example, it has been found that whereas in cutting certain materials at the far zone without the benefit of the invention, the far cutting zone is found about 300 nozzle orifice diameters in distance away from the work (assuming the environment surrounding the cutting jet is air), with the instant invention the far zone is reduced to about 200 nozzle diameters in length. Cutting at this shortened distance requires less than one-half the amount of energy required at the greater distance.

The invention is particularly applicable to fluid jet cutting in a relatively high density, e.g., liquid, environment. Whereas far zone cutting simply cannot be obtained with a conventional liquid jet submerged within, for example, water, the utilization therewith of the invention enables cutting in as high density environment with the same results obtained when the surrounding atmosphere is air. Thus, the present invention makes practical the use of fluid jets in many useful cutting applications, such as in deep well drilling, through a drilling mud environment.

The invention includes other features and advantages which will be described or will become apparent from the following more detailed description of a preferred embodiment.

DETAILED DESCRIPTION OF A PREFERRED EMBODIMENT

Figure 1:
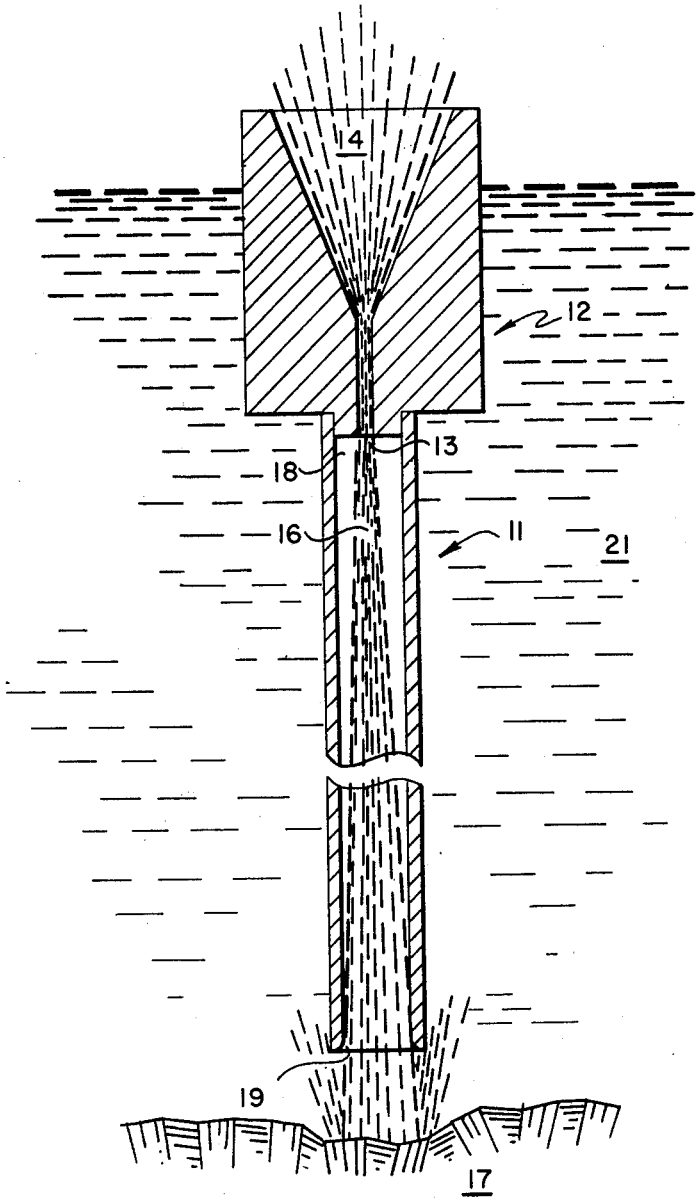
FIG. 1 is a somewhat schematic, sectional side view of a preferred embodiment of the shroud of the invention attached to a jet cutting nozzle.

With reference to the accompanying drawings, FIG. 1 is an overall view of a preferred embodiment, generally referred to by the reference numeral 11, of the shroud of the invention attached to the nozzle 12 of a liquid jet cutting drill. The shroud is, in effect, an elongated tube having an entrance end threadably received on the nozzle 12 circumscribing its liquid discharge orifice 13. The threadable securance provides a generally hermetic seal between the nozzle and tube which is detachable. Thus, a user of the jet cutting nozzle 12 can replace one shroud with another having a different length, shape or cross-sectional area, to optimize the cutting effect for any given conditions, such as nozzle geometry, type of work to be cut, nature of surrounding fluid medium, etc.

A liquid cutting medium 14, such as water, is forced through the orifice 13 to form a high velocity cutting jet 16 which impinges upon the work or substrate material 17 it is desired be cut. As illustrated, the cross-sectional area and shape of the interior of the tube 11 is spaced for substantially the full length of the tube from the jet 16. The result is that a two-phase (gas-liquid) flow is induced within the tube by the jet as it passes therethrough. In this connection, the inner periphery of the tube 11 defines a circular cylinder. The jet itself has a generally circular cross-section, with the result that a low-pressure, low density, quiescent annular region 18 is formed adjacent the nozzle between the jet and inner periphery of the tube. Thus, when the jet first exits from the orifice 13 it exits into an intermediate expansion chamber. It has been found that the cutting effect of the jet when it impinges upon the substrate 17 is therefore enhanced. This enhancement is particularly notable when the nozzle is spaced from the work 17 sufficiently to cut in the far zone. As mentioned previously, it has been found that with use of the shroud of the instant invention the far cutting zone is reached when the nozzle is spaced about 200 nozzle orifice diameters from the work, whereas without the shroud the far cutting zone is typically not reached until about 300 nozzle orifice diameters distance. The result is that significantly less energy is required to produce a desired cut than would otherwise be required. While the shroud of the invention is utilizable with a fluid jet irrespective of the distance it is desired such jet be spaced from the workpiece, it is preferred that its length be selected for cutting in the near zone or for cutting in the far zone. Thus, it is preferred that the length of the tube from the jet orifice to the discharge end thereof be between 10 and 25 times the diameter of the orifice, or between about 175 and 300 times the diameter of such orifice. In this connection, it will be noted that the lower limit of the far zone range is lowered when the shroud of the invention is used. The inner periphery of the tube adjacent its discharge end is flared outward as indicated at 19. This flared construction is believed to reduce deleterious interaction of the jet with the tube at such discharge end. Although it is not critical, it is preferred in most situations that the discharge end of the tube be spaced about five nozzle diameters away from the workpiece.

As mentioned previously, the shroud of the invention has made cutting workpieces from the far zone possible even in those situations in which the surrounding environment has a high density. The shroud of the invention is shown in FIG. 1 extending through such a high density environment, water, referred to by the reference numeral 21. When the environment is such a high density one, it is preferable that the discharge end of the tube 11 have an interior cross-sectional area and shape selected to be generally coincident with the cross-sectional area and shape at the location of such end of the liquid jet emanating therefrom. This relationship is represented in the figure in which it is seen that the jet just engages the discharge end of the tube. The purpose of this is to inhibit the flow of water 21 into the interior of the tube from its discharge end. Of course, the back pressure to the jet flow caused by the high density environment will tend to cause the jet to spread out at the discharge end of the tube. This is to be taken into account in determining the shape and cross-sectional area of the jet at such tube end.

Figure 2:
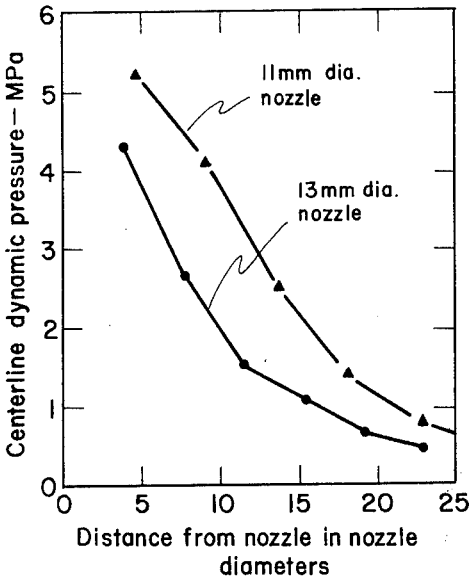
FIG. 2 is a graph of the attenuation of center line dynamic pressure of a conventional submerged jet as a function of distance from the nozzle.
Figure 3:
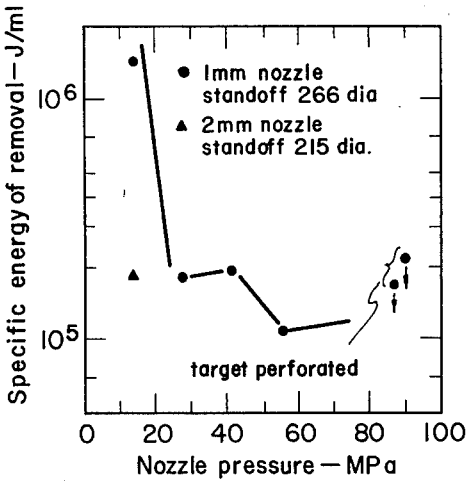
FIG. 3 is a graph of the specific energy of removal for Indiana limestone as a function of nozzle pressure for a submerged jet nozzle making use of the shroud of the invention.
Figure 4:
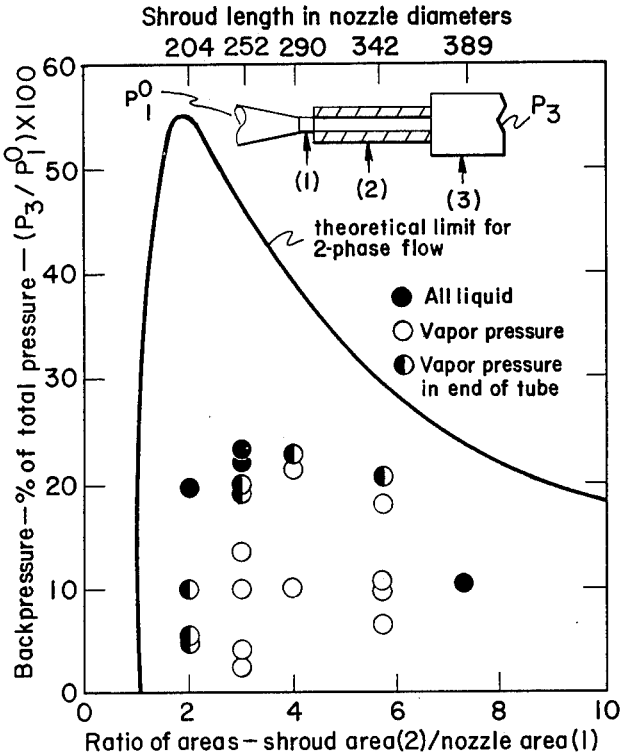
FIG. 4 is a graph of the two-phase flow with intermediate sudden expansion that characterizes liquid jet cutting nozzles.

The graphs of FIGS. 2–4 are included to provide empirical evidence of the effectiveness of the instant invention. FIG. 2 depicts some measurements for water jets submerged in water without the shroud of the invention. As shown therein, the dynamic pressure drops to about 40% within ten to fifteen nozzle diameters of the orifice, whereas in air the same pressure drop occurs at about three hundred diameters. Far zone cutting does not occur for a simple submerged jet.

FIG. 3 shows the cutting performance obtained by adding a shroud to the jet cutting nozzle in a water tank with relatively low-pressure heads imposed on the water. The cutting efficiency of the shrouded jet is generally the same as that obtained with a cutting nozzle surrounded by air. However, as mentioned previously, the lowest threshold pressures are obtained at standoffs of about two hundred, rather than three hundred nozzle orifice diameters. In air, cutting at this distance requires more than twice the energy.

FIG. 4 illustrates two-phase flow in the intermediate, sudden expansion zone that characterizes shrouded nozzles. Partly open circles denote the region of apparent cavitation. The solid line in FIG. 4 shows a predicted upper bound for cavitation as a function of the shroud-to-nozzle area ratio. Above this line, it is postulated that momentum cannot be conserved even if there were no losses and the velocity profiles in the cross-sections were optimal.

The circles in FIG. 4 indicate observed conditions in the shroud for tests which have been run. Two-phase flow for the length of the shroud was noted in the region occupied by open circles. The partly open circles indicate some gas phase near either the nozzle or the working end. If it is assumed that submerged far zone cutting depends on the conditions denoted by open circles, the highest feasible back pressure demonstrated in FIG. 4 is about 21%.

The shroud of the invention may be constructed of any material which is compatible with the nozzle and will resist the pressures of the environment they are to be used in. Metals, such as stainless steel, may generally be used.

From the above it will be seen that the shroud of the invention has several features which represent improvements over the prior art. Although the shroud has been described in connection with a preferred embodiment thereof, it will be appreciated that various changes and modifications can be made without departing from its spirit. For example, the shroud can be made an integral part of a jet cutting nozzle, rather than be detachable as described. It is therefore intended that the coverage afforded applicant be limited only by the claims and their equivalent language.

I claim:

1. A shroud for the fluid jet nozzle of a fluid cutting drill designed to cut material comprising an elongated tube having a fluid entrance end adapted to be secured generally hermetically to the drill nozzle circumscribing the fluid discharge orifice thereof, and a fluid discharge end opposite said entrance end for flow through said tube of a material cutting fluid jet emanating from said orifice; the cross-sectional area and shape of the interior of said tube being selected to be spaced for substantially the full length of said tube from such a fluid jet emanating from said orifice whereby flow therethrough of said fluid jet causes a reduction of pressure in said tube to form an expansion chamber, and the length of said tube from said orifice to the discharge end thereof being between about 175 to 300 times the diameter of said orifice.

2. A shroud for the fluid jet nozzle of a fluid jet cutting drill having an orifice of substantially circular cross-section comprising an elongated tube having an inner periphery defining a generally circular cylinder with an entrance end adapted to be detachably secured hermetically to said nozzle circumscribing the fluid discharge orifice thereof and a fluid discharge end opposite said entrance end for flow through said tube of a material cutting fluid jet emanating from said orifice; the length of said tube from said orifice to the discharge end thereof being between about 175 to 300 times the diameter of said orifice, the cross-sectional area and shape of the interior of said tube being selected to be spaced for substantially the full length of said tube from such a fluid jet emanating from said orifice whereby flow therethrough of said fluid jet causes a reduction of pressure in said tube to form an expansion chamber, the ratio of the cross-sectional area of the interior of said tube to the cross-sectional area of the orifice of the jet cutting nozzle being between about 2:1 and 15:1, and said discharge end of said tube having an interior cross-sectional area selected to be generally coincident with the cross-sectional area at the location of such end of a fluid jet emanating from said orifice.

3. A shroud for the fluid jet nozzle of a fluid cutting drill designed to cut material in an underwater environment comprising an elongated tube having a fluid entrance end adapted to be secured generally hermetically to the drill nozzle circumscribing the fluid discharge orifice therein and separating the same from said underwater environment, and a fluid discharge end opposite said entrance end for flow through said tube of a material cutting fluid jet emanating from said orifice; the cross-sectional area and shape of the interior of said tube being selected to be spaced for substantially the full length of said tube from such a fluid jet emanating from said orifice whereby flow therethrough of said fluid jet causes a reduction of pressure in said tube to form an expansion chamber, said fluid discharge end being spaced from the material to be cut whereby cutting fluid emanating therefrom passes through said underwater environment before impinging on said material.

* * * * *